US007926806B2

(12) United States Patent
Blair et al.

(10) Patent No.: US 7,926,806 B2
(45) Date of Patent: Apr. 19, 2011

(54) SYSTEMS FOR ALIGNING A MEDIA SHEET IN AN IMAGE FORMING APPARATUS

(75) Inventors: Brian Allen Blair, Richmond, KY (US); Kristi Ann Kappes, Kalispell, MT (US); Jason Lee Rowe, Richmond, KY (US); Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 347 days.

(21) Appl. No.: 12/036,587

(22) Filed: Feb. 25, 2008

(65) Prior Publication Data

US 2009/0212489 A1 Aug. 27, 2009

(51) Int. Cl.
*B65H 9/12* (2006.01)

(52) U.S. Cl. ..... 271/241; 271/248; 271/252

(58) Field of Classification Search ..... 271/241, 271/145, 171, 248, 250, 251, 252
See application file for complete search history.

(56) References Cited

U.S. PATENT DOCUMENTS

| | | | | |
|---|---|---|---|---|
| 5,375,826 | A * | 12/1994 | Flores | 271/10.01 |
| 5,806,844 | A * | 9/1998 | Bailey et al. | 271/145 |
| 6,356,735 | B1 * | 3/2002 | Hozumi | 399/395 |
| 2006/0214363 | A1 * | 9/2006 | Kawashima et al. | 271/226 |

* cited by examiner

*Primary Examiner* — Stefanos Karmis
*Assistant Examiner* — Michael C McCullough
(74) *Attorney, Agent, or Firm* — John Victor Pezdek

(57) ABSTRACT

A system for aligning a media sheet in a media path of an image forming apparatus includes an input area with an alignment edge to initially laterally align the media sheet. The media sheet may then move through an alignment nip which is constructed to laterally move the media sheet against a reference edge. The media sheet moves along the reference edge and become aligned prior to moving to a transport belt. The media sheet may then move through one or more transfer nips to receive one or more images.

14 Claims, 6 Drawing Sheets

SYSTEMS FOR ALIGNING A MEDIA SHEET IN AN IMAGE FORMING APPARATUS

BACKGROUND

The present application is directed to alignment systems and methods for use in an image forming apparatus and particularly to systems and methods that move a media sheet against a reference edge as the media sheet moves along a media path.

Image forming apparatus' include a media path for moving media sheets from an input area, through a transfer area, and ultimately to an output area that is usually on an exterior of the apparatus. The input area may include a variety of constructions, including but not limited to an input tray. A pick arm may be pivotally positioned to contact a top-most media sheet in the input tray. The pick arm is activated and drives the top-most media sheet from the input tray and along the media path. The media path may also include one or more nips formed between opposing rolls. The nips may function to drive the media sheets along the media path and/or to align the media sheets. The transfer area includes one or more imaging units that transfer an image onto the media sheets.

The media sheets should move along the media path in a consistent fashion. This is necessary to ensure the media sheets are located at the transfer area at the precise time to receive the images. The media sheets should also be aligned by the time they reach the transfer area. Proper alignment ensures the images are positioned at the correct position on the media sheets. A misaligned media sheet at the transfer station may result in a print defect as the image is not centered or otherwise located on the media sheet.

The media path should also be constructed in a manner to prevent media jams. The media jams are frustrating to the user as it requires intervention to clear the jam and restart the image formation process. Further, media jams may damage the media sheets and/or the image forming apparatus.

SUMMARY

The present application is directed to systems and methods to align a media sheet in a media path of an image forming apparatus. In one embodiment, the system may include an input area with an alignment edge to initially laterally align the media sheet. The media sheet may then move through an alignment nip which is constructed to laterally move the media sheet against a reference edge. The media sheet moves along the reference edge and becomes aligned prior to moving to a transport belt. The media sheet may then move through one or more transfer nips to receive one or more images.

DETAILED DESCRIPTION

Figure 1:
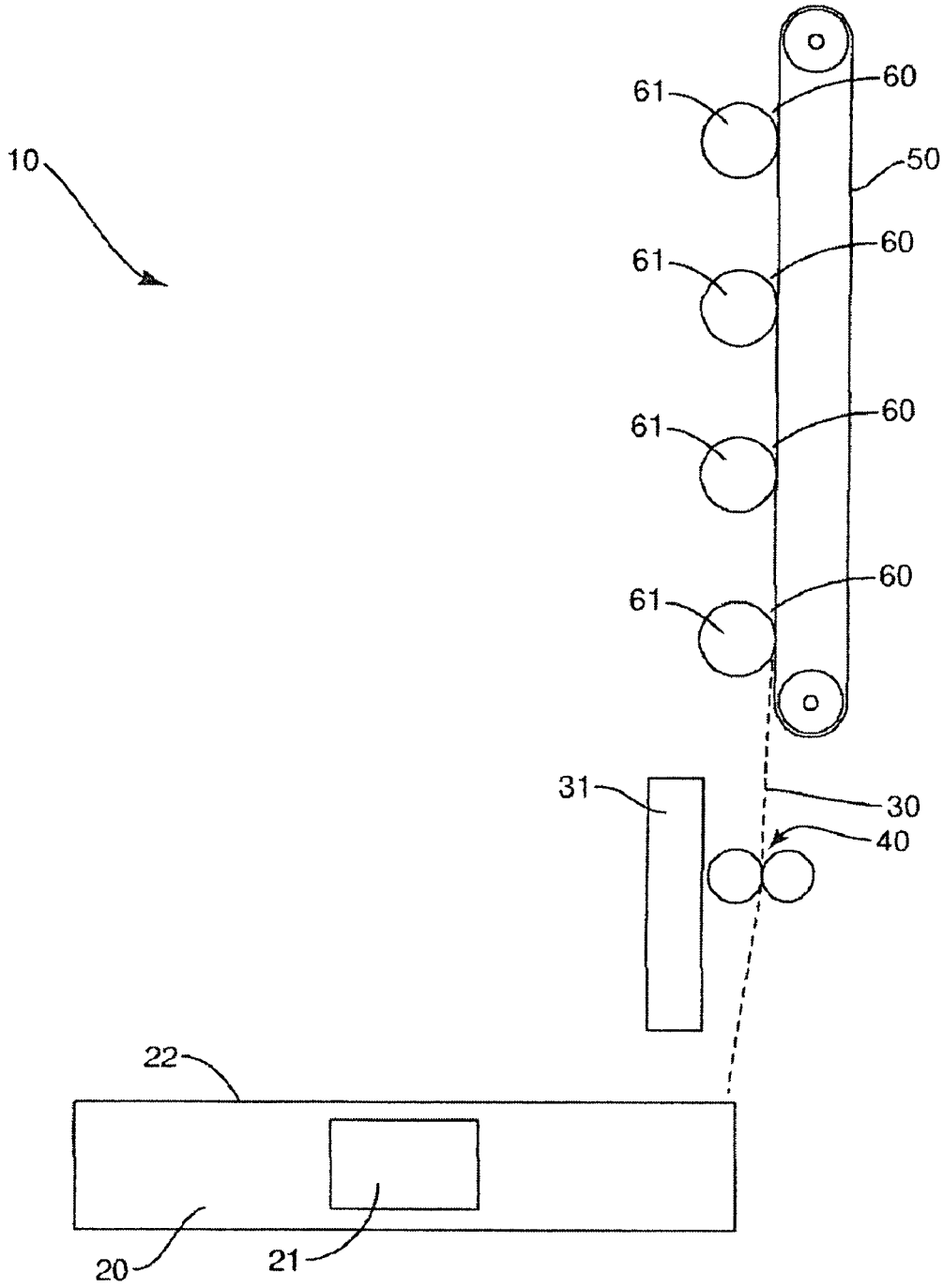
FIG. 1 is a schematic view of a portion of a media path of an image forming apparatus according to one embodiment.

The present application is directed to systems and methods to align a media sheet moving along a media path. FIG. 1 illustrates schematically one embodiment of a system 10 that includes generally an input tray 20, alignment nip 40, and a transport belt 50. A media sheet is initially stored in the input tray 20 and aligned by a biasing mechanism 21 against a first reference edge 22. The media sheet is moved from the input tray 20 along the media path 30 through an alignment nip 40 for further alignment along a second reference edge 31. The aligned media sheet than moves to the transport belt 50 where it receives images from one or more PC members 61.

Figure 2:
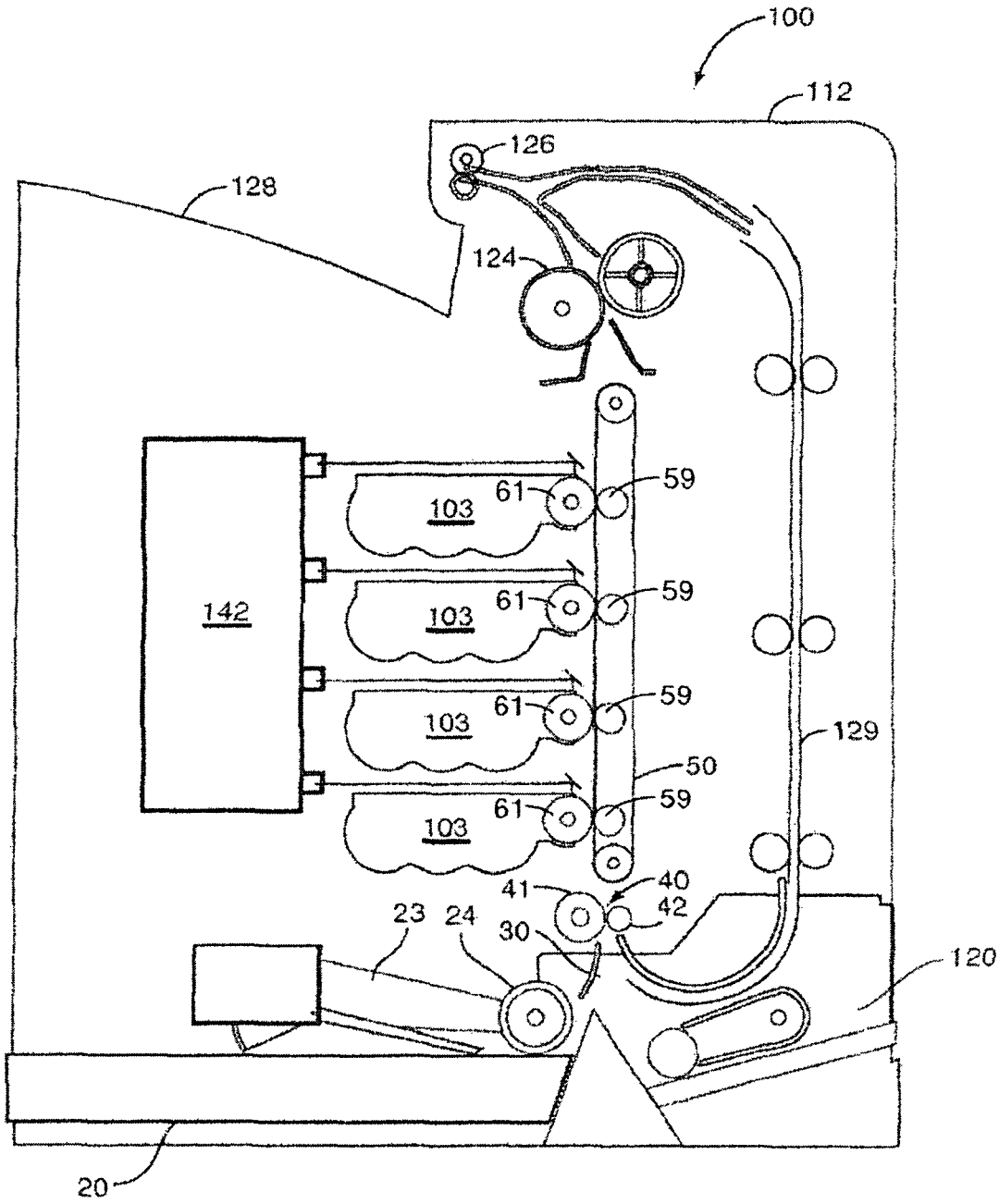
FIG. 2 is a side schematic view of an image forming apparatus according to one embodiment.

To better understand the context of feeding media sheets, FIG. 2 includes one embodiment of an image forming apparatus 100. The image forming apparatus 100 comprises a main body 112 with an input tray 20 for holding a stack of media sheets. A pick arm 23 is positioned for a roll 24 to rest on the top-most sheet in the input tray 20.

In use, a media sheet is moved from the input tray 20 and moved into the media path 30. The alignment nip 40 is formed between a drive roll 41 and a backup roll 42 to align the media sheet prior to passing to a transport belt 50 and past a series of image forming stations 103. A print system 142 forms a latent image on a photoconductive member 61 in each image forming station 103 to form a toner image. The toner image is then transferred from the image forming station 103 to the passing media sheet.

Color image forming devices typically include four image forming stations 103 for printing with cyan, magenta, yellow, and black toner to produce a four-color image on the media sheet. The transport belt 50 conveys the media sheet with the color image thereon towards a fuser 124, which fixes the color image on the media sheet. Exit rolls 126 either eject the print media to an output tray 128, or direct it into a duplex path 129 for printing on a second side of the media sheet. In the latter case, the exit rolls 126 may partially eject the print media and then reverse direction to invert the media sheet and direct it into the duplex path 129. A series of rolls in the duplex path 129 return the inverted print media to the primary media path for printing on the second side.

Figure 3:
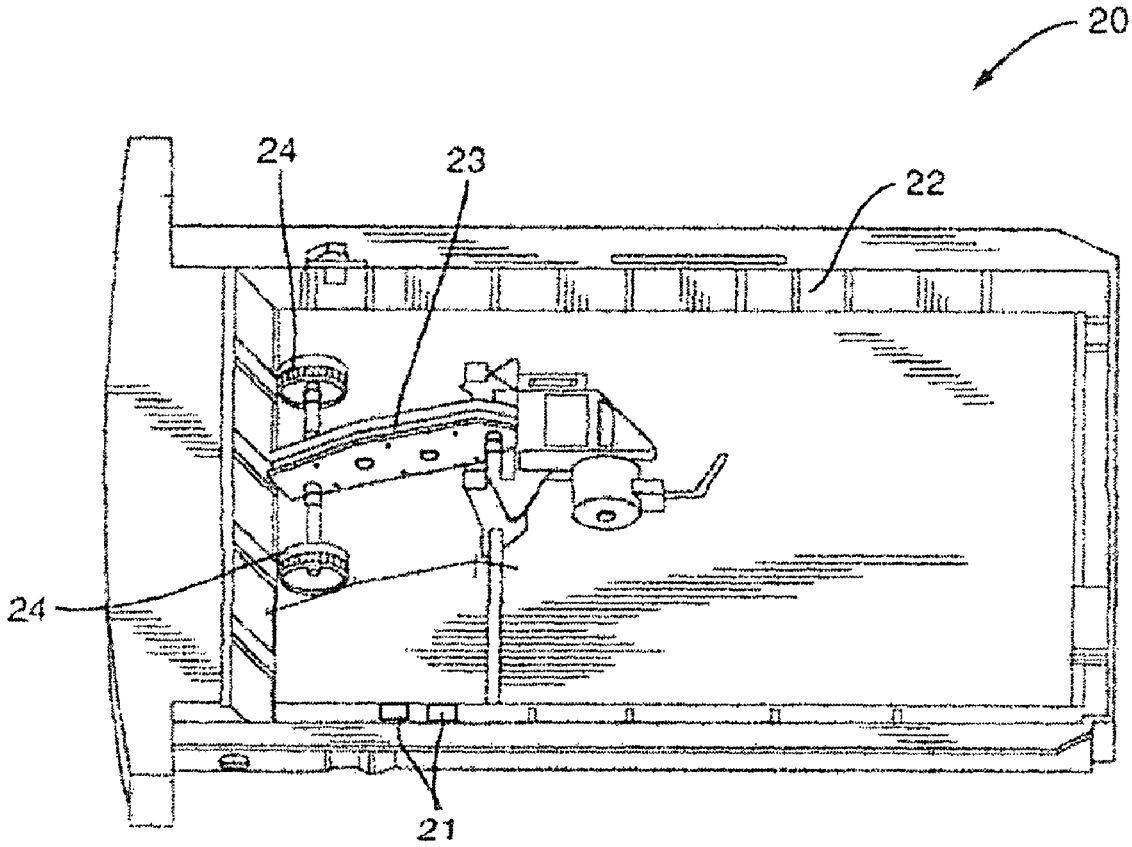
FIG. 3 is a perspective view of an input tray and a pick mechanism according to one embodiment.

A first alignment of the media sheets occurs within the input tray 20. FIG. 3 illustrates one embodiment of an input tray 20 positioned under a pick arm 23 and rolls 24. The input tray 20 is sized to hold one or more media sheets. A reference edge 22 is positioned along one lateral side to initially align the media sheets. The input tray 20 also includes one or more biasing mechanisms 21 positioned opposite from the reference edge 22. The one or more biasing mechanisms 21 force the media sheets against the reference edge 22. In one embodiment, the reference edge 22 is flat.

Figure 4:
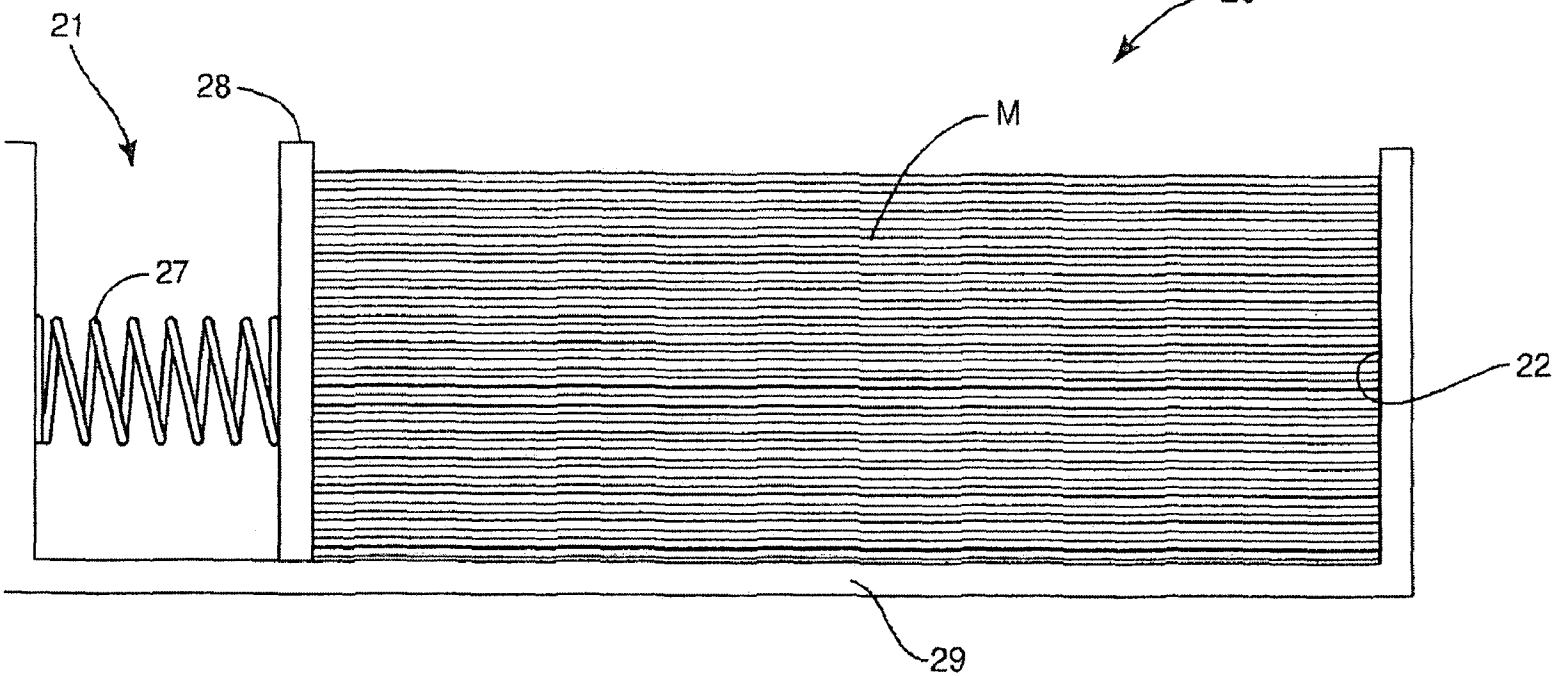
FIG. 4 is a side sectional view of a biasing mechanism positioned within an input tray according to one embodiment.

FIG. 4 illustrates one embodiment of a biasing mechanism 21 that includes a spring 27 and a contact member 28. The contact member 28 is movable across a floor 29 of the input tray 20. The spring 27 forces the contact member 28 against a first side of the media sheets M. This force is then transferred to the media sheet M which aligns a second side of the media sheets M against the reference edge 22. In one embodiment, the biasing mechanism 21 includes multiple springs 27 that act against a single contact member 28. In another embodiment, multiple contact members 28 are positioned along the floor 29 with each being forced by one or more springs 27. Other embodiments of biasing mechanisms 21 are disclosed in U.S. patent application Ser. No. 11/851,416 filed on Sep. 7, 2007 and entitled "Media Tray Restraint Devices and Methods of Use", which is herein incorporated by reference.

Figure 5:
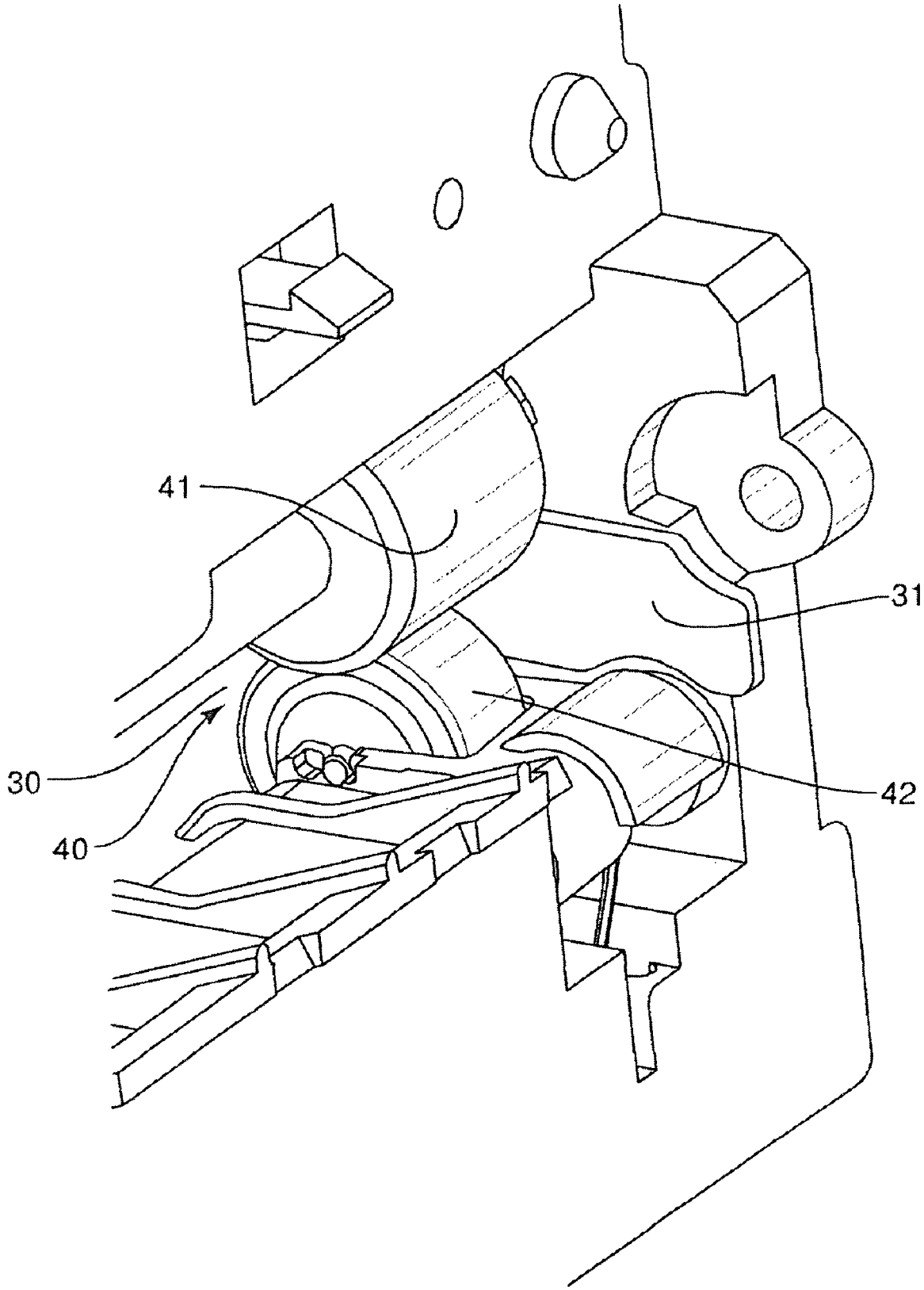
FIG. 5 is a perspective view of an alignment nip positioned relative to a reference edge according to one embodiment.
Figure 6:
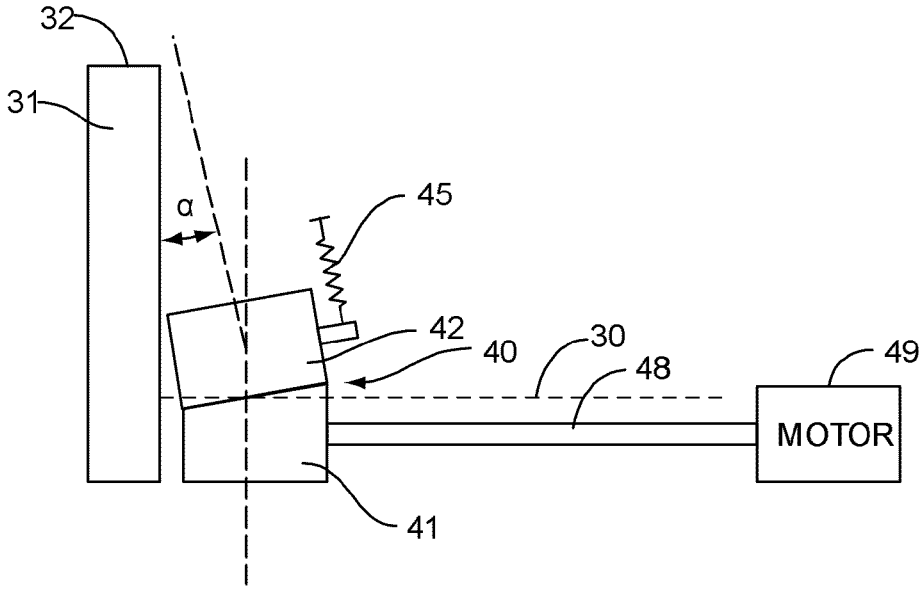
FIG. 6 is a schematic view of a drive roll and backup roll positioned relative to a reference edge according to one embodiment.
Figure 7:
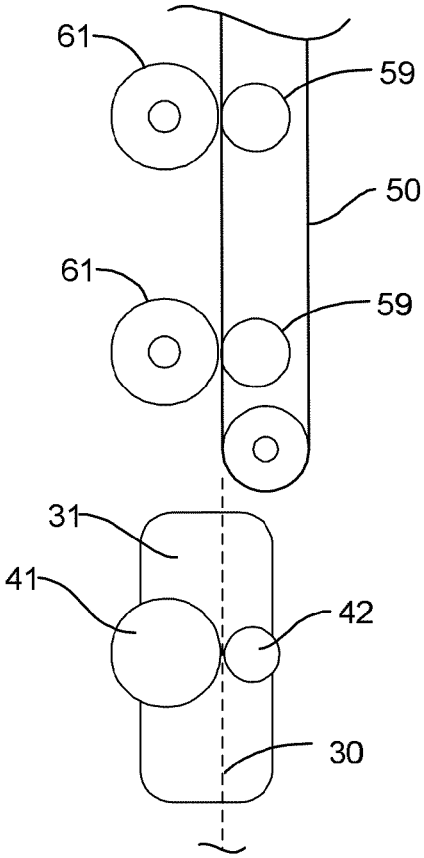
FIG. 7 is a partial schematic view of a transport belt positioned downstream from an alignment nip and a reference edge according to one embodiment.

After leaving the input tray 20, the media sheet moves further along the media path 30 and into the alignment nip 40 as illustrated in FIGS. 5 and 6. The alignment nip 40 includes a drive roll 41 in contact with a backup roll 42. In one embodiment, multiple drive rolls 41 and backup rolls 42 are spaced laterally across the width of the media path 30 with each of the rolls 41, 42 including a limited width. In another embodiment, the alignment nip 40 includes a single drive roll 41 and/or a single backup roll 42 that extend laterally across a larger width of the media path 30.

The drive roll 41 may be connected to a shaft 48 that is driven by a motor 49. Motor 49 drives the drive roll 41 in a forward direction to move the media sheet further along the media path 30. The drive roll 41 may be constructed from a soft durometer material. In one specific embodiment, the drive roll 41 is constructed to have a hardness of between about 50-70 shore A. The size of the drive roll 41 may vary, and in one embodiment includes a diameter of about 15-17 mm.

The backup roll 42 is positioned against the drive roll 41 to form the alignment nip 40. A biasing means such as spring 45 may be operatively connected to the backup roll 42 to create a nip force with the drive roll 41. In one embodiment, the spring 45 creates a nip force of about 0.5-2 lbs. In one embodiment, the backup roll 42 is harder than the drive roll 41. The nip force may result in slight deformation of the drive roll 41 because the biasing force of the spring slightly alters the rotational axis of the backup roll 42 to intersect with the plane of the media path 30 (See FIG. 6).

In one embodiment, the motor 49 may be unidirectional. In addition to driving the rolls 41, 42 forward, the motor 49 may also drive the rolls backward. In one embodiment, the rolls 41, 42 are driven backwards to form a buckle in the media sheet to remove any skew in the media sheet.

The reference edge 31 is a flat surface used for aligning an edge of the media sheet as the media sheet moves along the media path 30. The reference edge 31 is positioned between the input tray 20 and the transport belt 50. In one embodiment, a downstream end 32 of the reference edge 31 is spaced upstream from an upstream end of the transport belt 50. The reference edge 31 may include a gentle lead-in from a bottom of the reference edge 31 to the media path 30 to prevent damage to the media sheet during alignment.

As best illustrated in FIG. 6, the reference edge 31 is located laterally across the media path 30 from the alignment nip 40. The alignment nip 40 aligns the media sheet by directing the media sheet against the reference edge 31. To accomplish the alignment, a centerline of the backup roll 42 is positioned at an angle $\alpha$ relative to the reference edge 31. This positioning causes the media sheet to move through the alignment nip 30 and towards the reference edge 31. The angle $\alpha$ may vary between about >0° and 10°. In one specific embodiment, the angle $\alpha$ is about 5°. The drive roll 41 is positioned to be substantially parallel with the reference edge 31.

In use, the media sheet is initially loaded into the input tray 20. Once loaded, the biasing mechanism 21 abuts against the first side of the media sheet and aligns the second side of the media sheet against the edge 22. The media sheet is ultimately picked from the input tray 20 by the pick arm 23 and roll(s) 24 and moved along the media path 30. The media sheet moves into the alignment nip 40. The position of the backup roll 42 causes the media sheet to be moved laterally as it is driven forward along the media path 30. The lateral movement causes the second side of the media sheet to contact and align against the reference edge 31. In one embodiment, the media sheet is moved laterally about 1 mm as it moves through the alignment nip 40 and against the reference edge 31.

The media sheet is further driven along the media path 30 and into contact with the transport belt 50. The media sheet then moves through one or more of the transport nips 61 formed between the transport belt 50 and the photoconductive members 61 at each respective transfer roll 59.

In one embodiment, the media sheet is still moving through the alignment nip 40 as the media sheet moves through one or more of the transfer nips 60. The transfer nips 60 may move the media sheet at a slower speed than the alignment nip 40. This speed differential prevents the alignment nip 40 from placing any tension on the media sheet as it moves through the one or more transfer nips 61. In one embodiment, the media sheet may form a buckle upstream from the first transfer nip 61.

In one embodiment, a transfer nip force is formed between the photoconductive member 61 and the transport belt 50 where it is supported by the transfer roll 59. The transfer nip force may be greater than an alignment nip force formed between the rolls 41, 42 at the alignment nip 40.

In one embodiment, the backup roll 42 is positioned at a non-parallel angle relative to the reference edge 31. In another embodiment, the backup roll 42 is parallel with the reference edge 31 and the drive roll 41 is positioned at a non-parallel angle relative to the reference edge 31.

One type of input area for initially aligning the media sheet is an input tray 20 as discussed above. Another input area includes a multi-purpose feeder 120 as illustrated in FIG. 2. The feeder 120 provides an avenue for inputting various types of media sheets. The feeder 120 may include a reference edge to initially align the media sheets prior to being moved into the alignment nip 40. In one embodiment, feeder 120 includes one or more biasing mechanisms 21 to force the media sheets against the reference edge.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A system to align a media sheet in a media path of an image forming apparatus comprising:

an input area including a support member to support the media sheet and a first reference edge to initially align a lateral side of the media sheet;

a second reference edge located downstream along the media path from the input area, the second reference edge offset laterally from the first reference edge;

an alignment nip located downstream along the media path from the input area, the alignment nip comprising:

a drive roll aligned parallel with the second reference edge, a backup roll aligned transverse to the second reference edge; and a biasing means for creating a nip force between the backup roll and the drive roll, the biasing means causing a rotational axis of the backup roll to intersect a plane of the media path;

a transport belt located downstream along the media path from the alignment nip; and a transfer nip formed between a photoconductive member and the transport belt.

2. The system of claim 1, wherein the second reference edge includes an upstream end and a downstream end, the downstream end positioned upstream from the transport belt.

3. The system of claim 1, wherein the second reference edge includes a length measured between a first end and a second end, the second reference edge offset laterally from the alignment nip with the first end positioned upstream from the alignment nip and the second end positioned downstream from the alignment nip.

4. The system of claim 1, wherein a centerline of the backup roll forms an angle of 5° with the second reference edge.

5. The system of claim 1, wherein the first reference edge of the input area is laterally offset from the second reference edge.

6. The system of claim 1, wherein an alignment nip force at the alignment nip is less than a transfer nip force at the transfer nip.

7. The system of claim 1, wherein the backup roll is harder than the drive roll.

8. The system of claim 1, wherein application of the nip force deforms the drive roll.

9. The system of claim 1, wherein the biasing means comprises a spring acting against the backup roll.

10. A system to align a media sheet in a media path of an image forming apparatus comprising:

an input tray sized to hold the media sheet and including a floor, a contact member on a first side of the tray that is movable relative to the floor, and a first reference edge on a second side of the tray opposite from the contact member;

a second reference edge positioned downstream from the input tray and positioned laterally outward from the first reference edge of the input tray, each of the first and second reference edges being flat to align a lateral side of the media sheet;

an alignment nip positioned downstream from the input tray and including a drive roll and a backup roll, a centerline of the backup roll positioned at a non-parallel angle to the drive roll to direct the media sheet laterally against the second reference edge;

a spring for biasing the backup roll against the drive roll deforming the drive roll such that a rotational axis of the backup roll intersects a plane of the media path;

a transport belt located downstream from the alignment nip and the second reference edge; and a transfer nip formed between a photoconductive member and the transport belt.

11. The system of claim 10, wherein the second reference edge includes a length measured between a first end and a second end, the first end positioned upstream from the alignment nip and the second end positioned downstream from the alignment nip.

12. The system of claim 10, wherein the centerline of the backup roll forms a non-parallel angle with the second reference edge.

13. The system of claim 10, wherein the first reference edge of the input tray is laterally offset from the second reference edge.

14. The system of claim 10, wherein an alignment nip force is less than a transfer nip force.

* * * * *